US008899327B2

(12) United States Patent
Kuhlman et al.

(10) Patent No.: US 8,899,327 B2
(45) Date of Patent: Dec. 2, 2014

(54) METHOD FOR RECOVERING HYDROCARBONS USING COLD HEAVY OIL PRODUCTION WITH SAND (CHOPS) AND DOWNHOLE STEAM GENERATION

(75) Inventors: Myron I. Kuhlman, Houston, TX (US); Charles H. Ware, Palm Harbor, FL (US)

(73) Assignee: World Energy Systems Incorporated, Fort Worth, TX (US)

( * ) Notice: Subject to any disclaimer, the term of this patent is extended or adjusted under 35 U.S.C. 154(b) by 679 days.

(21) Appl. No.: 13/117,624

(22) Filed: May 27, 2011

(65) Prior Publication Data

US 2011/0297374 A1 Dec. 8, 2011

Related U.S. Application Data

(60) Provisional application No. 61/350,718, filed on Jun. 2, 2010.

(51) Int. Cl.
*E21B 43/24* (2006.01)

(52) U.S. Cl.
CPC ..... *E21B 43/24* (2013.01)
USPC ..... 166/272.3; 166/272.1

(58) Field of Classification Search
USPC ..... 166/50, 261, 272.1, 272.3, 370, 372
See application file for complete search history.

(56) References Cited

U.S. PATENT DOCUMENTS

| | | | | |
|---|---|---|---|---|
| 7,845,219 | B2 * | 12/2010 | Goodwin et al. | 73/152.24 |
| 8,408,313 | B2 * | 4/2013 | Yale et al. | 166/370 |
| 2009/0012765 | A1 * | 1/2009 | Raphael | 703/10 |
| 2011/0278001 | A1 * | 11/2011 | Schneider et al. | 166/272.3 |
| 2011/0297374 | A1 * | 12/2011 | Kuhlman et al. | 166/272.3 |
| 2013/0020076 | A1 * | 1/2013 | Schneider et al. | 166/261 |
| 2013/0096890 | A1 * | 4/2013 | Vanderheyden et al. | 703/2 |
| 2013/0269949 | A1 * | 10/2013 | Young et al. | 166/372 |

* cited by examiner

*Primary Examiner* — Daniel P Stephenson
(74) *Attorney, Agent, or Firm* — Patterson & Sheridan, LLP

(57) ABSTRACT

A method for recovering oil from a reservoir comprises performing a first CHOPS process in one or more first wells, performing a second CHOPS process in one or more second wells that are laterally offset from the first wells, and injecting gas and/or steam into the one or more second wells after the CHOPS processes are at least partially completed. A plurality of channels that extend from the one or more first and second wells may be created as a result of the CHOPS processes. The gas and/or steam may be injected into the channels of the one or more second wells via a downhole steam generator that is located in the one or more second wells. The gas and/or steam may form a gas and/or steam front that drives reservoir products into the channels of the one or more first wells. The reservoir products may be recovered to the surface through the one or more first wells.

32 Claims, 9 Drawing Sheets

METHOD FOR RECOVERING HYDROCARBONS USING COLD HEAVY OIL PRODUCTION WITH SAND (CHOPS) AND DOWNHOLE STEAM GENERATION

CROSS REFERENCE TO RELATED APPLICATIONS

This application claims benefit of U.S. Provisional Patent Application Ser. No. 61/350,718, filed Jun. 2, 2010, the content of which is herein incorporated by reference in its entirety.

BACKGROUND OF THE INVENTION

1. Field of the Invention

Embodiments of the invention generally relate to enhanced oil recovery methods. More specifically, embodiments of the invention relate to methods of recovering oil from a reservoir using a downhole steam generation drive process after a cold heavy oil production with sand process.

2. Description of the Related Art

Oil can generally be separated into classes or grades according to its viscosity and density. Grades of oil that have a high viscosity and density may be more difficult to produce from a reservoir to the surface. In particular, extra heavy oil requires enhanced oil recovery techniques for production. In the following description, the generic term "oil" includes hydrocarbons, such as extra heavy oil, as well as less viscous grades of oil.

A large portion of the world's potential oil reserves is in the form of heavy or extra heavy oil, such as the Orinoco Belt in Venezuela, the oil sands in Canada, and the Ugnu Reservoir in Northern Alaska. Currently, some existing oil reservoirs are exploited using thermal enhanced oil recovery techniques that usually result in recovery efficiencies within a range of about 20% to 75%. One of the most common thermal enhanced oil recovery techniques is surface steam injection by which heat enthalpy from the steam is transferred to the oil by condensation. The heating reduces the viscosity of the oil to allow drainage and collection. Thus, oil recovery is high if the temperature can be maintained near the temperature of the surface injected steam.

In the Arctic, however, below the surface and extending to depths of 1500 feet or more, permafrost layers exist. It is thus impractical to generate steam on the surface and inject it into the formation below because the steam would have to pass through the permafrost layer. The high temperature steam may melt the permafrost layer, thereby causing it to expand and potentially crush any wellbores extending through the permafrost layers into the oil reservoirs below.

Alternatively in deep reservoirs or thin reservoirs, much heat is lost through the wellbore to the rock surrounding the reservoir. Then traditional steam injection is little more than a hot water flood and loses much of its effectiveness in reducing the oil's viscosity and improving oil production.

A current practice is to use Cold Heavy Oil Production with Sand ("CHOPS"). As the name implies, this utilizes primary production without heat. In general, a well is drilled into an unconsolidated reservoir, such as a highly porous tar sand formation. The well is perforated and a pumping device may be lowered into the well. The combination of reservoir pressure and artificial lift provided by the pumping device drives the oil in the reservoir to the well surface. Sand influx with the oil is encouraged by increasing the "draw down" pressure in the well (i.e. the differential pressure that drives fluids from the reservoir into the well), which enlarges the access of oil flow and decreases the resistance of fluid flow. A mixture of heavy oil and sand is produced and separated at the surface. One shortcoming of CHOPS is that the recovery efficiency can be as low as 5 percent of the original oil in place. Another shortcoming is that after the economic production limit is reached using the CHOPS process, the reservoir may not be suitable for other enhanced oil recovery techniques.

As the number of potential heavy oil reservoirs increases and the complexity of the operating conditions of these reservoirs increases, there is a continuous need for efficient enhanced oil recovery techniques and methods.

SUMMARY OF THE INVENTION

In one embodiment, a method for recovering oil from a reservoir may comprise drilling a first well into the reservoir; producing a first portion of oil and sand from the first well; drilling a second well into the reservoir; locating a downhole steam generator in the second well; injecting steam into the reservoir using the downhole steam generator to form a steam front; and producing a second portion of oil and sand from the first well, wherein the second portion of oil and sand is driven into the first well by the steam front.

In one embodiment, a method for recovering oil from a reservoir may comprise performing a first CHOPS process in one or more first wells; performing a second CHOPS process in one or more second wells; and injecting a fluid into the reservoir using a downhole device located in at least one of the one or more second wells.

In one embodiment, a method for recovering oil from a hydrocarbon-bearing reservoir having a first well and a second well, wherein the first well has been at least partially produced using a CHOPS process and includes one or more channels extending from the first well may comprise locating a downhole steam generator in the first well; generating steam downhole using the downhole steam generator; injecting gas and steam into the channels to form a gas and steam front in the reservoir; heating hydrocarbons in the reservoir using the gas and steam front; and producing the heated hydrocarbons from the second well.

In one embodiment, a method for recovering oil from a reservoir may comprise drilling a well into the reservoir; producing a first portion of oil and sand from the well; locating a downhole steam generator in the well; injecting steam into the reservoir using the downhole steam generator; and producing a second portion of oil and sand from the first well, wherein the second portion of oil and sand is heated by the injected steam.

In one embodiment, a method for optimizing reservoir production using a CHOPS process and drive process may comprise performing a first combined process including a CHOPS process and at least one of a gas and a steam drive process at a first location within a reservoir; performing a second combined process including a CHOPS process and at least one of a gas and a steam drive process at a second location within the reservoir; and comparing production output from the first and second combined processes to optimize subsequent combined CHOPS and at least one gas and steam drive processes for maximum oil recovery.

BRIEF DESCRIPTION OF THE DRAWINGS

So that the manner in which the above recited aspects of the invention can be understood in detail, a more particular description of embodiments of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
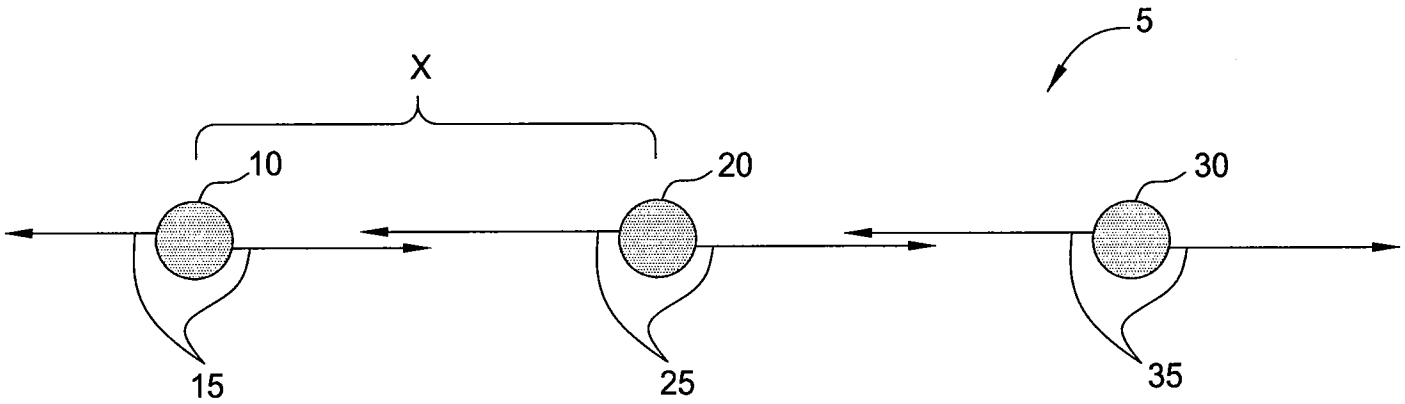
FIGS. 1A-1D illustrate an oil recovery process from a top view of a reservoir according to one embodiment.

Some oil reservoirs may be located several hundreds or even thousands of feet below permafrost layers, which may make it impractical to supply surface generated steam to the reservoir for conducting various enhance oil recovery techniques. The surface generated steam would have to pass through and may melt the permafrost layers, thereby causing it to expand and potentially crush any wellbores extending to the oil reservoir below. Embodiments of the invention may therefore include the use of downhole steam generators that are operable to generate high temperature steam downhole for injection into oil reservoirs that may be located below permafrost layers.

Embodiments of the invention generally relate to methods for increasing the recovery of oil from a reservoir. In one embodiment, the method includes a combination of a cold heavy oil production with sand ("CHOPS") operation and a drive operation. One or more downhole steam generators or other downhole mixing devices may be used to facilitate the drive operation. A first CHOPS process may be performed in one or more wells to produce oil, sand, and other fluids, gases, and/or solids from a reservoir. The reservoir pressure or a pumping device may be used to recover these reservoir products to the surface. A second CHOPS process similarly may be performed in one or more wells that are spaced from the first CHOPS process wells. As a result of the CHOPS processes, one or more channels may be formed in the reservoir. In one embodiment, the CHOPS processes may be controlled so that they are not conducted too long, so that the channels may extend primarily in one direction from the wellbores and do not overlap and/or interconnect with channels between drive/injection wells and production wells, as further described herein. In one embodiment, the channels may establish fluid communication between two or more wells. After the CHOPS processes are at least partially complete, a drive process may then be performed in one or more of the wells in which the first and/or second CHOPS processes were previously performed. One or more downhole steam generators are located in the drive process wellbores and one or more fluids are supplied to the steam generators to generate and inject gas and/or steam into the reservoir. In one embodiment, the downhole steam generator is operable to generate, exhaust, and inject high temperature steam and/or other gases, such as carbon dioxide, oxygen, nitrogen, and/or hydrogen, into the reservoir. The downhole steam generator has the advantage of generating steam and/or other gases downhole rather than at the surface. The injected gas and/or steam are distributed into the reservoir via the channels and form a gas and/or steam front to drive the reservoir products into the nearby channels and wells. In one embodiment, a gas front and a steam front are formed in the reservoir such that the gas front moves ahead of the steam front throughout the reservoir. The injected steam is distributed into the reservoir via the channels and may condense into heated water to heat the reservoir products, including the hydrocarbons, in the wells. Reservoir products are again produced from the one or more wells in which the first and/or second CHOP processes were previously performed.

FIGS. 1A-1D illustrate an oil recovery process from a top view of a reservoir according to one embodiment. In one embodiment, the method of producing oil from a reservoir 5 may include drilling one or more wells 10, 20, 30 into the reservoir 5. The wells 10, 20, 30 may be spaced a distance X from each other, which may include a range of about 100 feet to about 300 feet, 300 feet to about 600 feet, and/or about 600 feet to about 1400 feet. The reservoir 5 may include an unconsolidated rock-type formation, such as an unconsolidated sand formation. The reservoir 5 may be located below a permafrost layer, and/or may be a deep or thin reservoir. In one embodiment, the permafrost layer may be located about 1500 feet to about 1800 feet below the surface. In one embodiment, the reservoir 5 may be located about 500 feet to about 700 feet below the permafrost layer, for a total depth of about 2000 feet to about 2500 feet below the surface. The wells 10, 20, 30 may include vertical wells, horizontal wells, wells with angled trajectories, or combinations thereof.

A first enhanced oil recovery method may be used to recover oil from the reservoir 5. In one embodiment, the first enhanced oil recovery method may include a CHOPS process, which may be performed using the wells 10, 20, 30. The CHOPS process may include drilling the wells 10, 20, 30 into the reservoir 5, perforating one or more locations of the drilled wellbores, and recovering oil and sand from the reservoir 5 through the wells 10, 20, 30. In one embodiment, oil, sand, water, and/or various other fluids, gases, and/or solids may be recovered. In one embodiment, the oil, sand, and/or other reservoir products may flow to the surface by the reservoir 5 pressure. In one embodiment, the oil, sand, and/or other reservoir products may be pumped out of the reservoir using a pumping device, such as a progressive cavity pump. One or more artificial lift techniques may be used to recover the products from the reservoir 5. The recovered oil, sand, and/or other products may be separated at the surface.

During the CHOPS process, as sand is removed from the reservoir 5, the permeability of the reservoir 5 is increased. The permeable formation allows fluids and/or gases in the reservoir 5 to flow more easily through the formation to help drive the oil, sand, and other reservoir products to the surface. Production of sand with the oil may also prevent plugging of the formation and the wellbores. The pumping of sand from the reservoir 5 may create a plurality of channels 15, 25, 35, also known as "wormholes," that extend from the wellbore. A combination of high pressure gradients in the reservoir 5, as well as shear stresses provided by the flow of fluids, gases, and/or solids in the reservoir 5, may cause failures within the unconsolidated sand formation that generate the channels 15, 25, 35. The channels 15, 25, 35 may tend to progress in the layers of the reservoir 5 that are relatively porous, have relatively weak cohesive strength, and have sharp pressure gradients. The channels 15, 25, 35 may propagate from perforations in the wellbore and/or may form one or more elongated elliptical-shaped areas extending from the wellbore adjacent the perforations that includes a plurality of channels, depending on the permeability and earth stresses in the reservoir 5. The channels 15, 25, 35 allow more oil to reach the wellbores as they progress through the reservoir 5 and help reduce the drainage distance of the oil surrounding the channels 15, 25, 35. In one embodiment, the channels 15, 25, 35 may extend a distance of about 200 feet to about 400 feet and/or about 400 feet to about 700 feet from the wellbores. In one embodiment, the channels 15, 25, 35 may generally include a diameter in a range from about 4 or 6 inches to over 3 feet. The channels 15, 25, 35 may include vertical, lateral, or horizontal trajectories, and combinations thereof, depending on the reservoir 5 characteristics. In one embodiment, the development of the channels 15, 25, 35 may be facilitated by the draw down of the pressure in the reservoir 5 as the products are being produced and by the amount of pumping of products from the wellbores. In one embodiment, the direction in which the channels 15, 25, 35 form may be facilitated by perforating the wellbores adjacent to weaker formation layers in the reservoir 5.

As illustrated in FIG. 1A, the wells 10, 20, 30 may be produced using the CHOPS process until the channels 15, 25, 35 overlap and/or interconnect with each other. The channels 15, 25, 35 may establish fluid communication paths between the wells 10, 20, 30. The CHOPS process may be continued in one or more of the wells 10, 20, 30 until fluid communication is established and/or until oil production falls below a predetermined production rate.

Figure 1B:
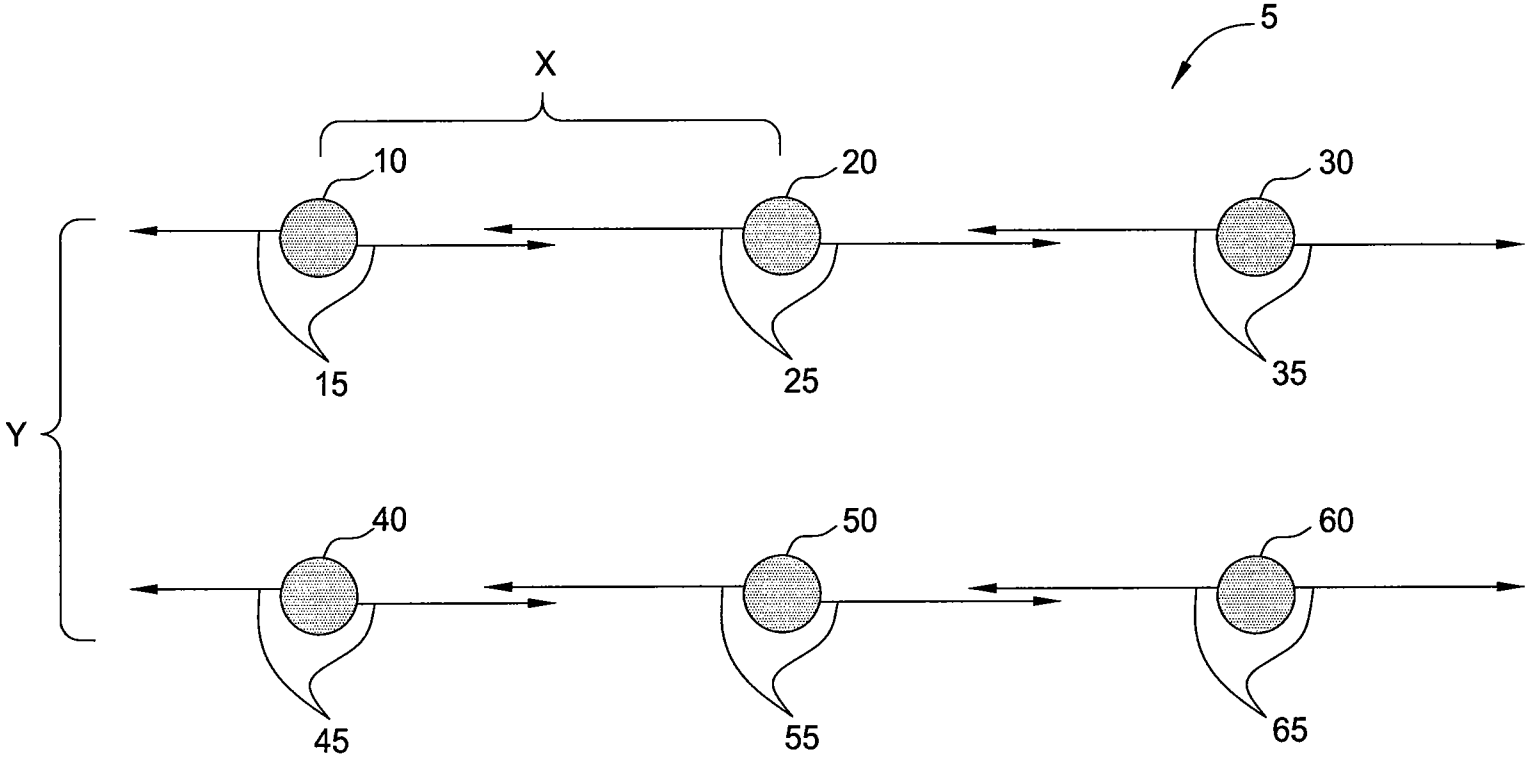

As illustrated in FIG. 1B, one or more wells 40, 50, 60 may be drilled into the reservoir 5. The wells 40, 50, 60 may be offset from the wells 10, 20, 30 by a distance Y, which may be within a range of about 900 feet to about 1500 feet and/or about 1500 feet to about 3000 feet. The row of wells 40, 50, 60 may also be similarly spaced and parallel to the row of wells 10, 20, 30. Other spatial locations may be used. In one embodiment, the wells 40, 50, 60 may be produced using the CHOPS process as described with respect to FIG. 1A, thereby generating one or more channels 45, 55, 65 that overlap and/or interconnect to establish fluid communication between the wells 40, 50, 60. In one embodiment, the wells 40, 50, 60 may be drilled and produced after the wells 10, 20, 30 are drilled and produced. In one embodiment, the wells 40, 50, 60 may be drilled and produced simultaneously with the wells 10, 20, 30. In one embodiment, the wells 40, 50, 60 may be produced for a shorter amount of time than the wells 10, 20, 30. In one embodiment, the channels 15, 25, 35 may be larger in size and/or length relative to the channels 45, 55, 65. In one embodiment, the drilling and production of the wells 10, 20, 30, 40, 50, 60, using the CHOPS process for example, may be performed in any order and for an amount of time necessary to achieve a desired result.

Figure 1C:
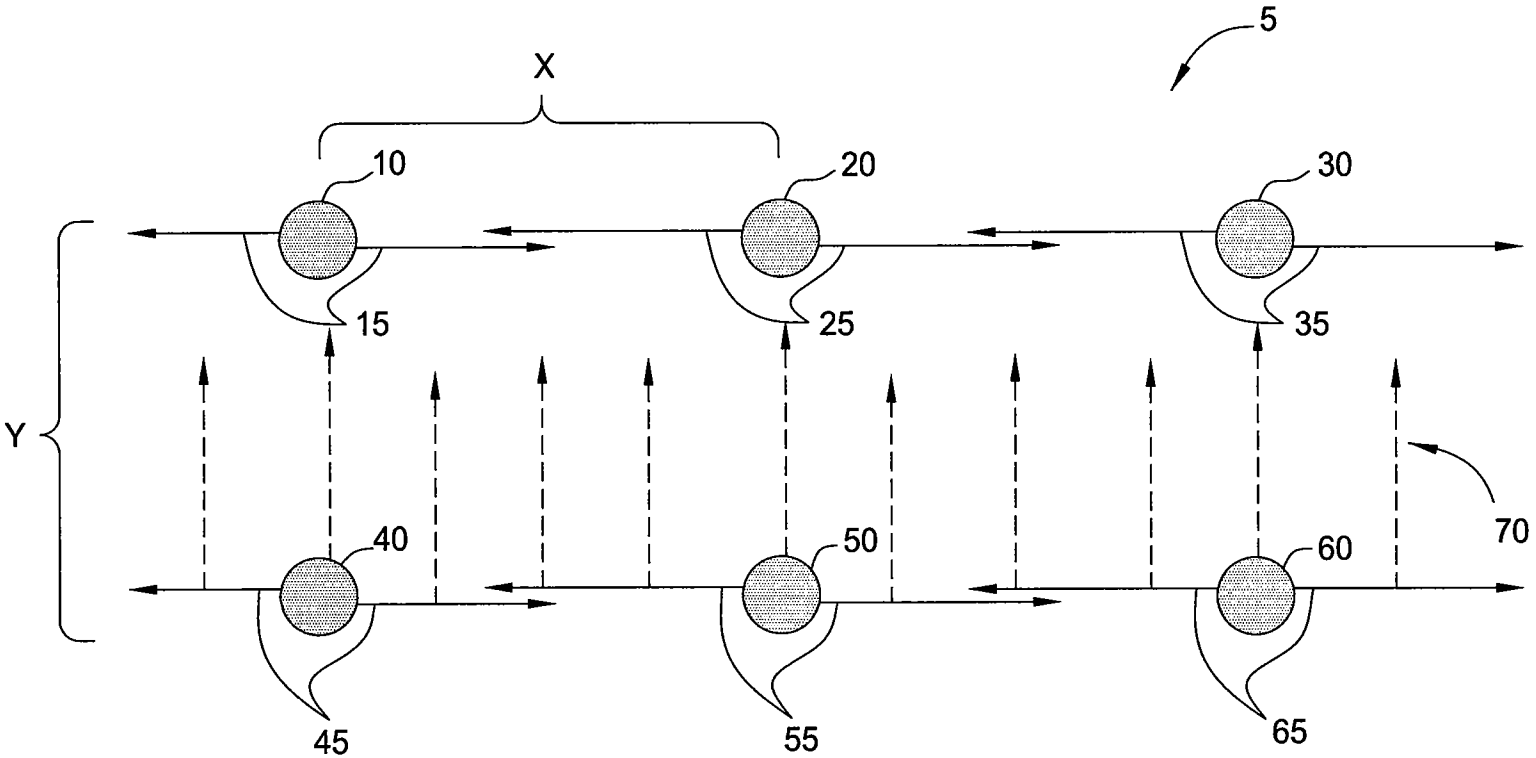

As illustrated in FIG. 1C, after the wells 10, 20, 30, 40, 50, 60 have been at least partially produced using the CHOPS process, a second enhanced oil recovery method may be performed to recover oil from the reservoir 5. In one embodiment, the second enhanced oil recovery method may include a gas and/or steam drive process. One or more downhole steam generators may be located near the channels 45, 55, 65 of wells 40, 50, 60. A fuel, an oxidant, and one or more additional fluids and/or gases may be supplied to the downhole steam generators and combusted to generate combustion products that are injected into the reservoir 5. In one embodiment, the fuel may comprise natural gas, syngas, methane, hydrogen and/or other fuels known in the art. In one embodiment, the oxidant may comprise oxygen, air, oxygen-enriched air, and/or other oxidants known in the art. In one embodiment, the additional fluids and/or gases supplied to the downhole steam generator may include air, water, steam, carbon dioxide, oxygen, nitrogen, hydrogen, and/or various cooling fluids/gases, solvents, non-condensable gases and/or inert gases. In one embodiment, the combustion products may include air, water, steam, superheated steam, carbon dioxide, oxygen, nitrogen, hydrogen, and/or various cooling fluids/gases, solvents, non-condensable gases and/or inert gases. The combustion products may flow through the channels 45, 55, 65 and out into the reservoir 5 to generate a gas and/or steam front 70, which may be used to drive the oil and/or sand in the reservoir 5 into the channels 15, 25, 35. The gas and/or steam front 70 may generate a pressure and/or temperature gradient in the reservoir 5 to help drive the oil and other reservoir products into wells 10, 20, 30. Steam injected into the reservoir 5 may condense into hot water to heat the hydrocarbons therein. Oxygen injected into the reservoir 5 may combust any residual oil remaining in the reservoir 5, and the heat from the combustion may generate additional steam and/or gases within the reservoir 5. In one embodiment, the combustion of the fuel, the oxidant, and/or other fluids sent to the downhole steam generators may create carbon dioxide gas that is injected into the reservoir to help recover the oil therein. The oil, sand, water, and/or other products may then be recovered from the wells 10, 20, 30 using the drive of the gas and/or steam front 70 and/or a pumping mechanism.

In one embodiment, one or more of the wells 40, 50, 60 may be used to continuously inject gas and/or steam into the reservoir 5 via the downhole steam generators and one or more of the wells 10, 20, 30 may be used to continuously produce oil, sand, and/or other products from the reservoir 5 via reservoir pressure and/or a pumping mechanism. The channels 15, 25, 35 may further progress during the subsequent production from the wells 10, 20, 30 to further enhance oil recovery. The injection and production processes may be performed repeatedly, conducted simultaneously, and/or conducted alternately for a period of time of about 3 months to about 12 months, about 1 year to about 5-10 years, and/or about 10 years to about 30 years. The recovered oil, sand, and/or products may be separated at the surface.

In one embodiment, after injecting gas and/or steam into the reservoir 5 via the downhole steam generators, the wells 40, 50, 60 may be converted back to production wells. In one embodiment, the reservoir 5 may be allowed to soak with the injected gas, steam, and/or combustion products for a period of time. Oil, sand, water, and/or other reservoir products may then be produced from the wells 40, 50, 60 after the injection. This process may also be repeated one or more times. In addition, the injection and/or production processes may be performed in any one of the wells 10, 20, 30, 40, 50, 60. In one embodiment, following the CHOPS and/or drive processes, reservoir products may be recovered from a well after removal of the downhole steam generator from that well. In one embodiment, reservoir products may be recovered from a well while the downhole steam generator is located in the same well. The recovered reservoir product flow may be directed around and/or through the downhole steam generator to the surface. In one embodiment, after any of the wells, 10, 20, 30, 40, 50, 60 are formed and/or any of the CHOPS processes are at least partially performed in any of the wells, carbon dioxide may be supplied from the surface into the reservoir 5. The carbon dioxide may be allowed to soak within the reservoir 5 for a period of time, such as for about 1 week to about 2 weeks or months, about 1 month to about 4 to 6 months, or longer. The downhole steam generators may be used to inject gas and/or steam into the reservoir 5 to drive the reservoir products to the surface, as described herein, anytime before, during, and/or after the carbon dioxide is injected into the reservoir 5.

Figure 1D:
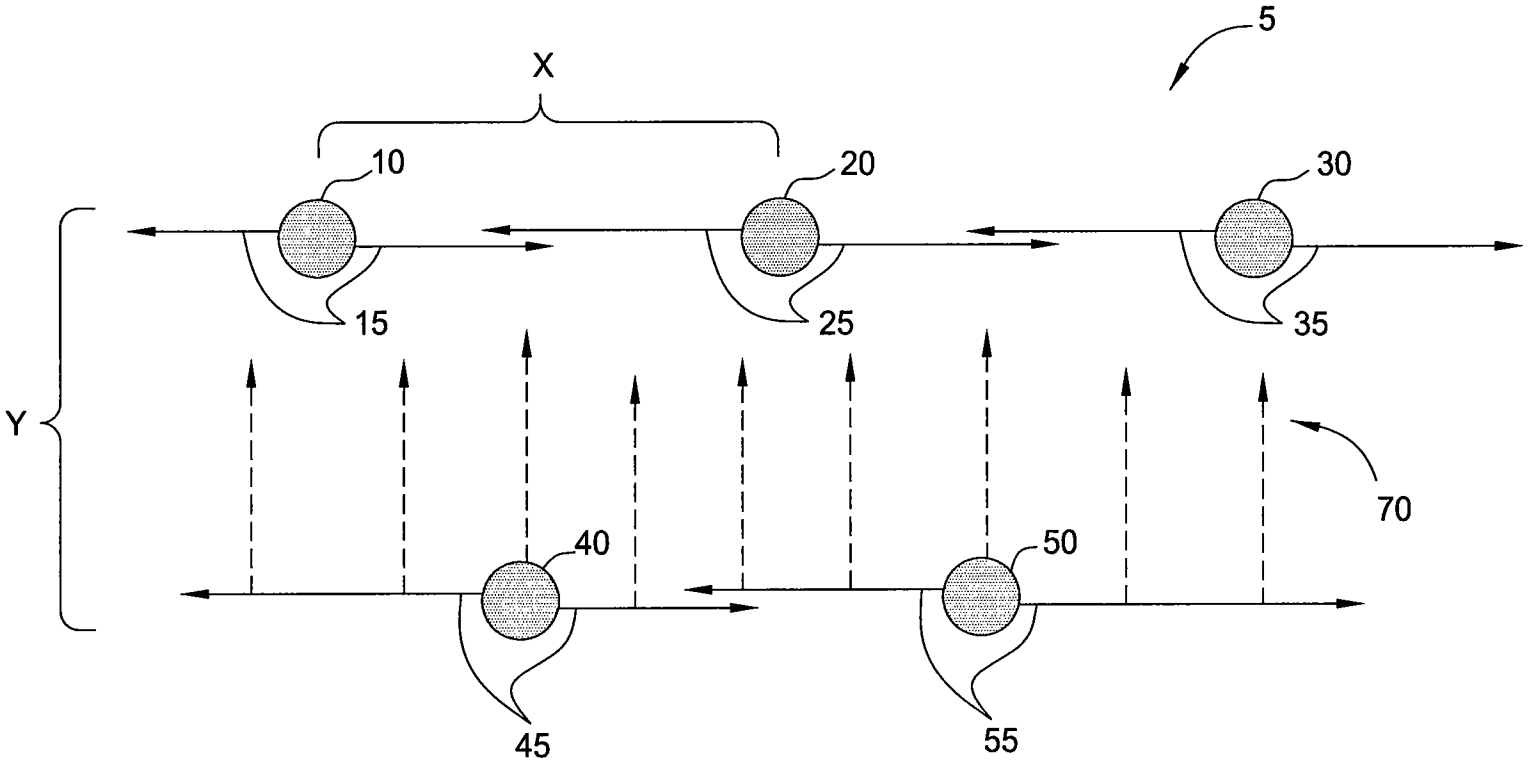

FIG. 1D illustrates an embodiment similar to that as described with respect to FIGS. 1A-1C, but uses two wells 40, 50 that are laterally offset from wells 10, 20, 30 in both the X and Y directions. Any number of wells and/or well patterns may be used with the embodiments described herein.

Figure 2A:
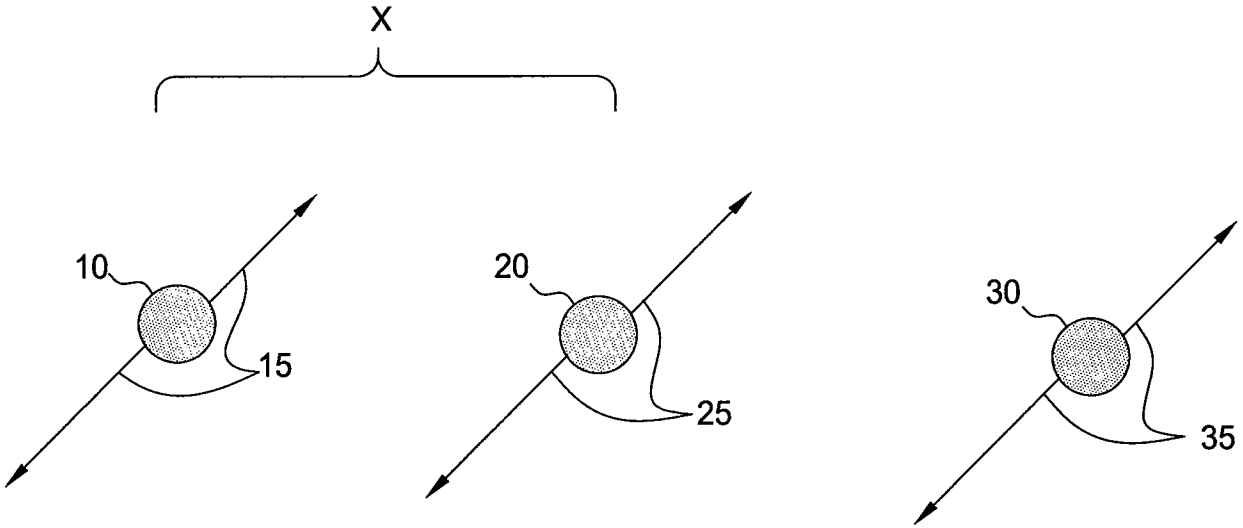
FIGS. 2A-2C illustrate an oil recovery process from a top view of a reservoir according to one embodiment.
Figure 2B:
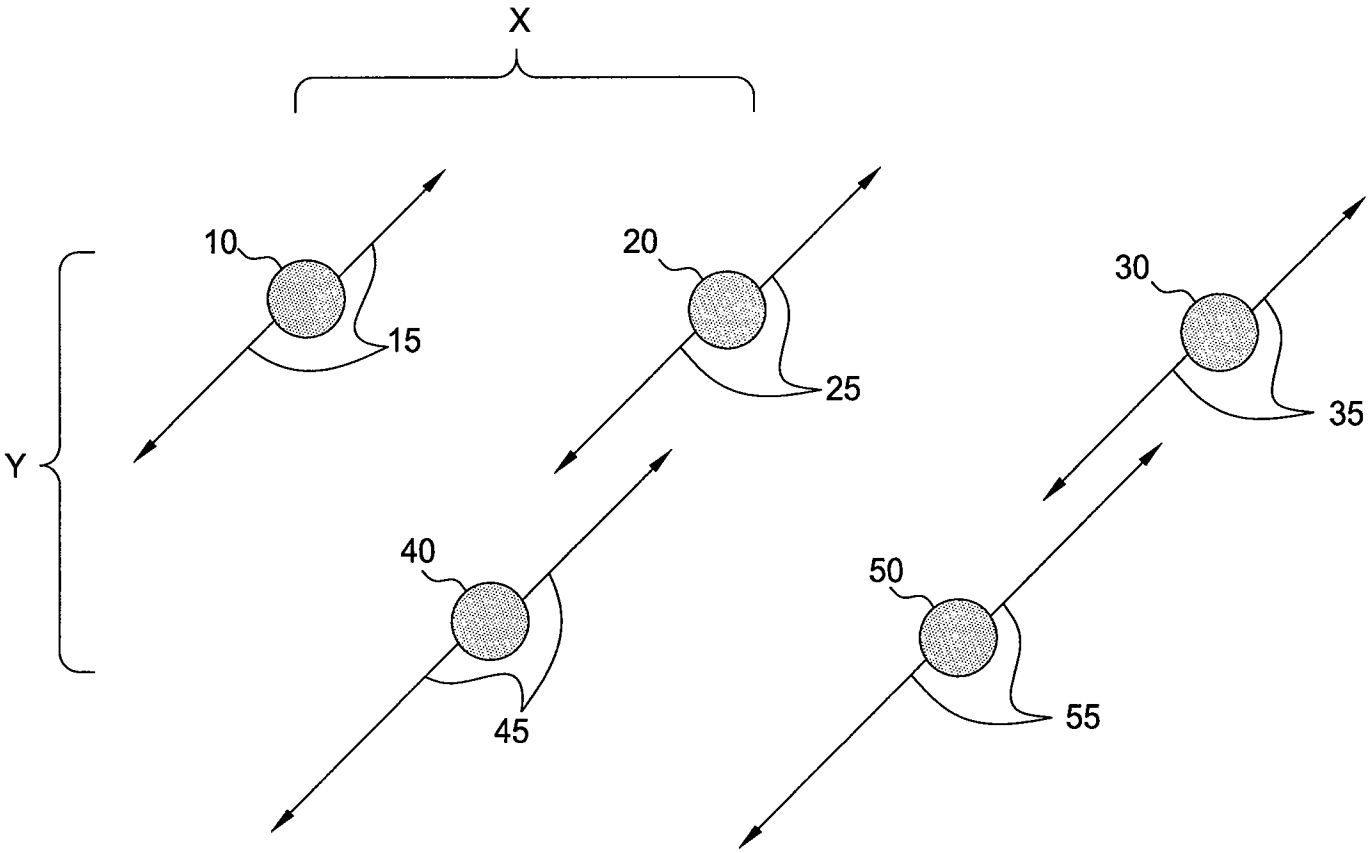
Figure 2C:
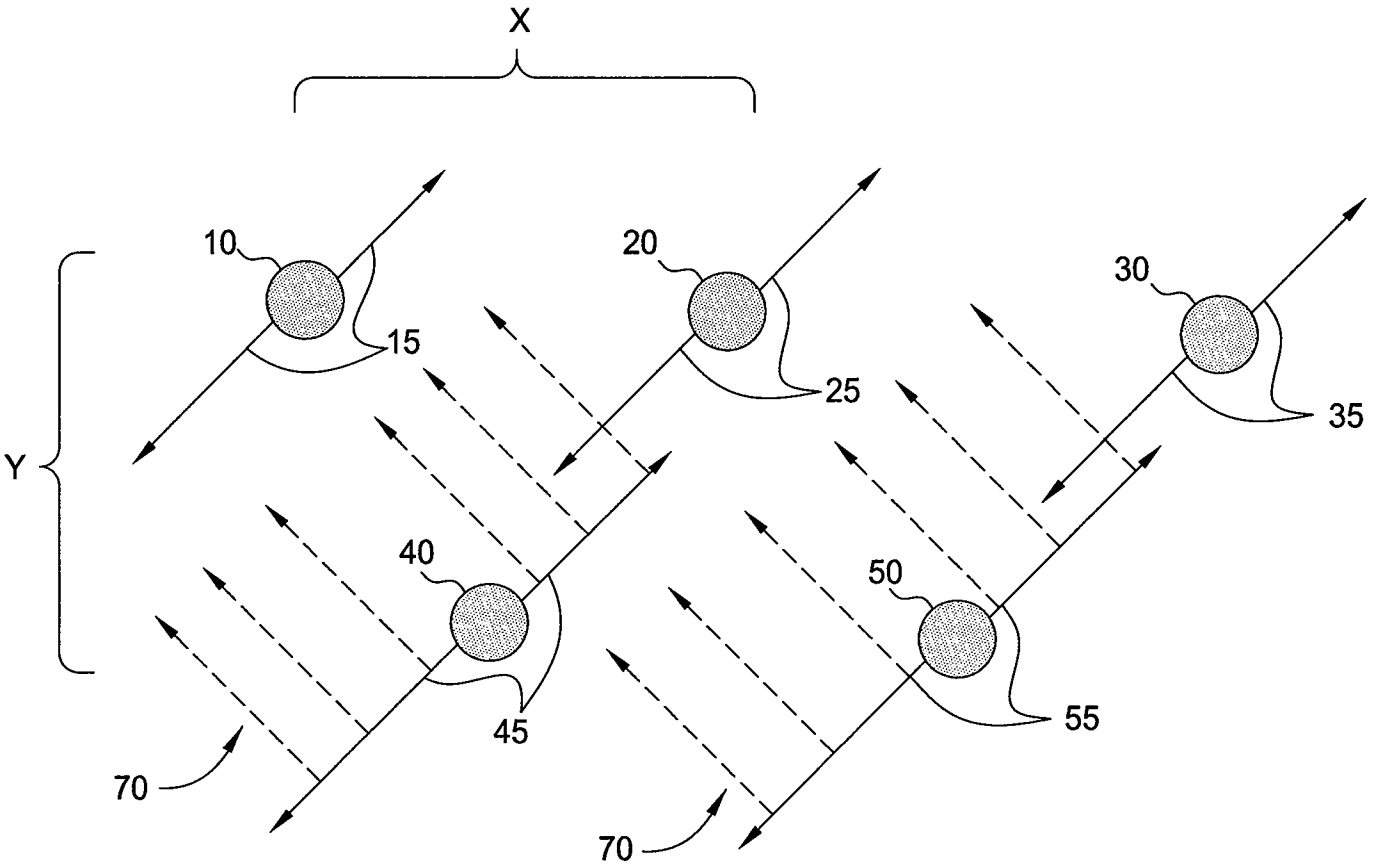

FIGS. 2A-2C illustrate an embodiment similar to that as described with respect to FIGS. 1A-1D, but shows the channels 15, 25, 35, 45, 55 extending from the wells at an angle relative to the horizontal axis. The channels 15, 25, 35, 45, 55 may extend at an angle in a range of about 5-10 degrees to about 80-85 degrees, about 20 degrees to about 70 degrees, about 30 degree to about 60 degrees, and/or about a 45 degree angle relative to the horizontal axis. The wells 40, 50 are laterally spaced from the wells 10, 20, 30 such that they may or may not overlap with and/or intersect with the channels 15, 25, 35. After the CHOPS process is at least partially performed in the wells 10, 20, 30 to form the channels 15, 25, 35, and/or after the CHOPS process is at least partially performed in the wells 40, 50 to form the channels 45, 55, one or more downhole steam generators may be placed in the wells 40, 50 to generate the gas and/or steam fronts 70. The wells 10, 20, 30 may be used to produce the heated oil from the reservoir 5 that is driven by the gas and/or steam fronts 70 and/or a pumping mechanism.

In one embodiment, the products produced from one or more of the wells 10, 20, 30, 40, 50, 60 may be cooled at the bottom of the wellbores prior to being retrieved to the surface. In one embodiment, a diluent may be injected into the bottom of the wellbores to cool the reservoir products. For example, the diluent may be a cooled low-viscosity fluid or gas that may also serve as a carrier for the produced products. The oil, sand, diluent, and/or other recovered reservoir products may then be separated at the surface. In one embodiment, the diluent may be injected into one or more of the wells 10, 20, 30, 40, 50, 60 during any point of the production and/or injection processes described above with respect to FIGS. 1A-1D and 2A-2C. In one embodiment, the wells may be insulated to protect from the thermal effects of high temperature products that are retrieved to the surface.

Figure 3:
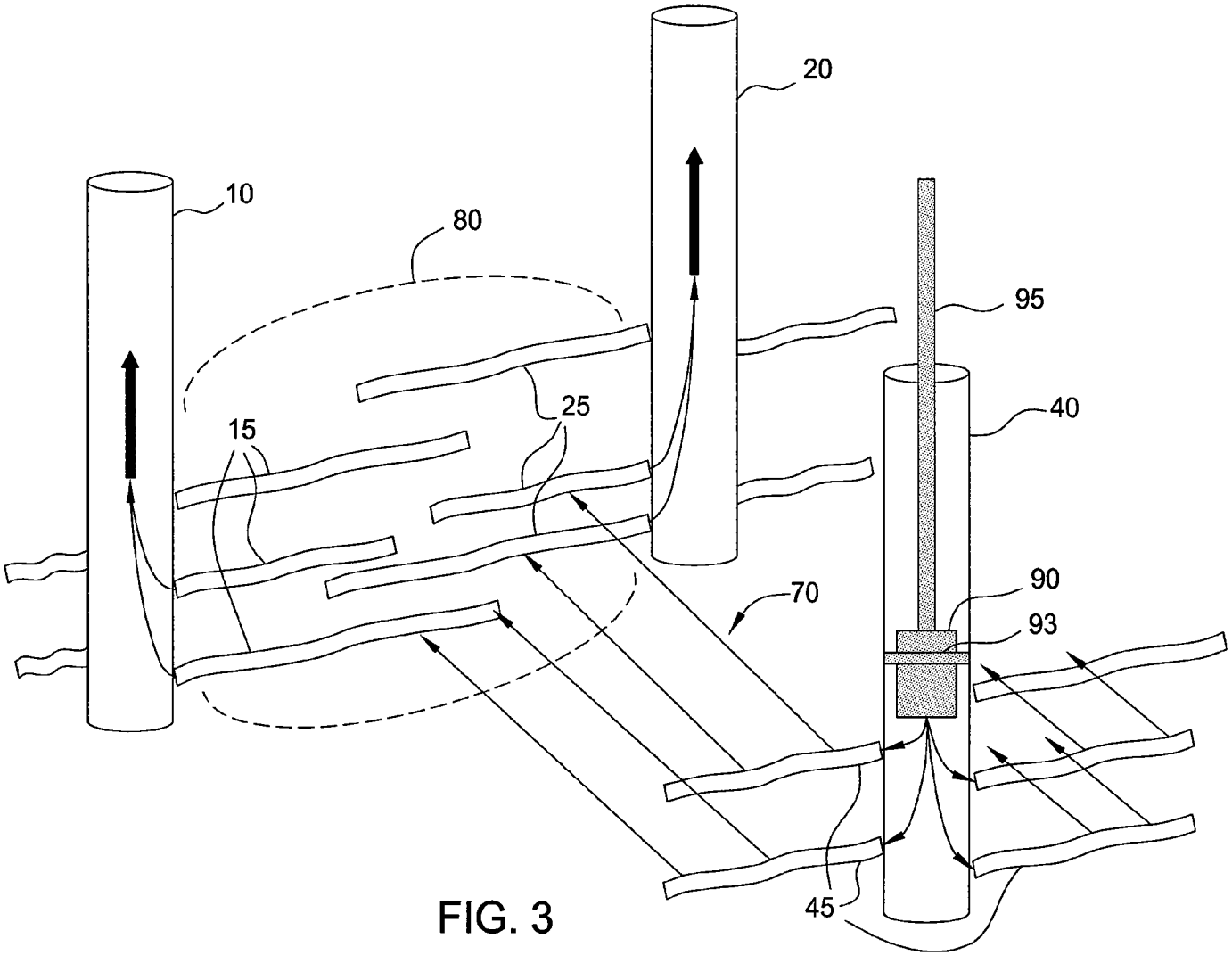
FIGS. 3 and 4 illustrate schematic views of the oil recovery process from the reservoir according to one embodiment.
Figure 4:
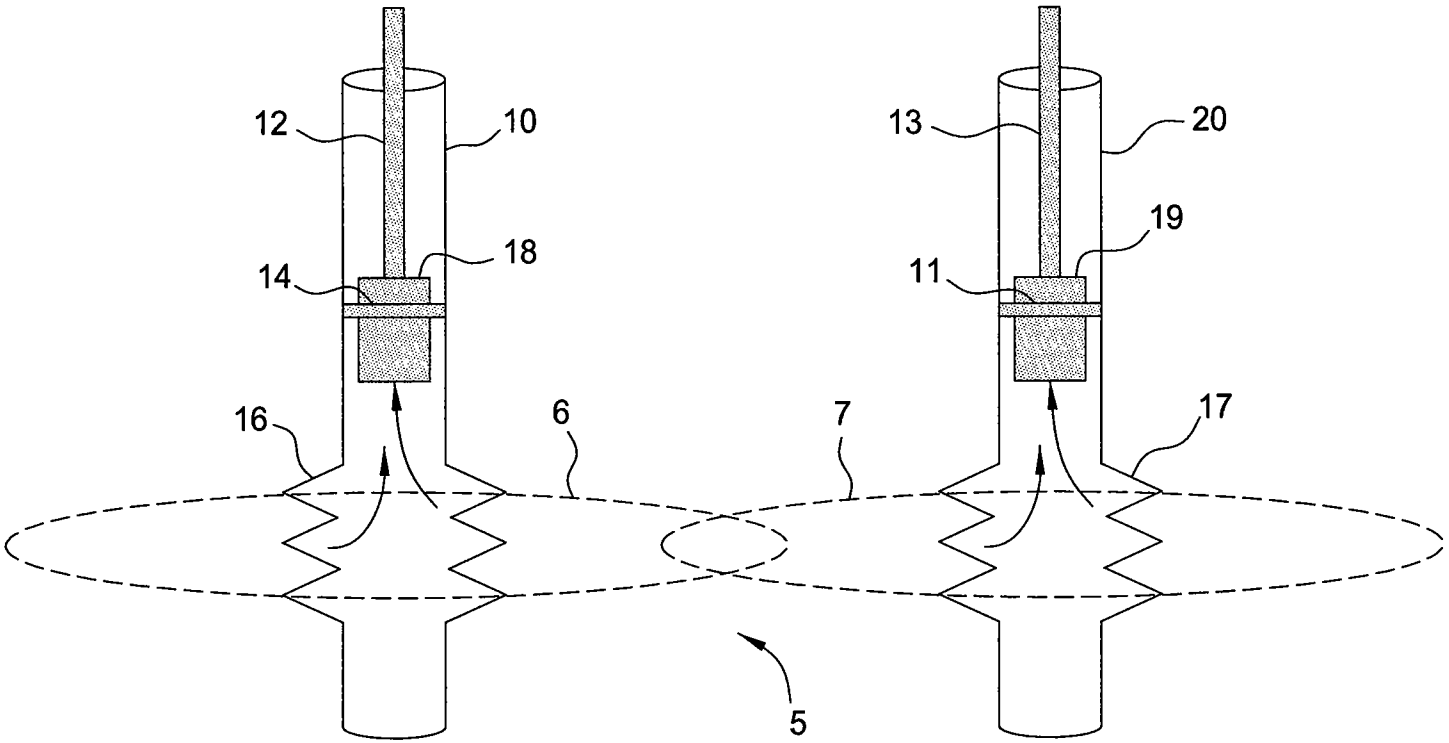

FIGS. 3 and 4 illustrate schematic views of one or more of the embodiments described above with respect to FIGS. 1A-1D and 2A-2C. As shown, one or more first wells 10 and one or more second wells 20, laterally spaced apart from the first well 10, may be drilled into a reservoir 5. The reservoir 5 may be an unconsolidated hydrocarbon-bearing reservoir, such as a tar sand formation. The wells 10, 20 may have one or more perforated sections 16, 17 and a CHOPS process may be at least partially performed in each well 10, 20, thereby forming one or more channels 15, 25 extending from each well. The channels 15, 20 may establish fluid communication between the wells 10, 20, which is identified as a zone of fluid communication 80. The channels 15, 25 may overlap, intersect, and/or lie adjacent to each other in the zone of fluid communication 80. Oil and sand may be produced from the reservoir 5 via the wells 10, 20 using the natural reservoir pressure and/or a pumping mechanism 18, 19, such as a progressive cavity pump. The pumping mechanisms 18, 19 may be located and operated in the wells 10, 20 using a work string 12, 13 comprising a plurality of sucker rods. The pumping mechanisms 18, 19 may also sealingly engage the wells 10, 20 via one or more seals 14, 11. As stated above, the channels 15, 25, 35 may propagate from perforations 16, 17 in the wellbore and/or may form one or more elongated elliptical-shaped areas 6, 7 extending from the wellbores adjacent the perforations and including a plurality of channels.

After a period of time, such as well before the wells 10, 20 are not producing a sufficient amount of oil for economical production, one or more third wells 40 may be drilled into the reservoir 5. The third well 40 may be offset from and/or laterally positioned between the wells 10, 20. The third well 40 may be perforated and a CHOPS process may be at least partially performed in the third well 40, thereby forming one or more channels 45 extending from the well. Oil and sand may be produced from the reservoir 5 via the third well 40 using the natural reservoir pressure and/or a pumping mechanism, such as a progressive cavity pump.

After a period of time, such as well before the third well 40 is not producing a sufficient amount of oil for economical production, a downhole steam generator ("DHSG") 90 may be positioned in the third well 40 using a work string 95. The DHSG 90 may be secured with a packer 93 near the perforated end of the third well 40 adjacent the channels 45. One or more fluids may be supplied to the DHSG 90 via the work string 95 to generate steam and/or other hot gases downhole. The gas and/or steam may be dispersed into the reservoir 5 through the channels 45, thereby forming a gas and/or steam front 70 that heats the remaining oil surrounding the wells 10, 20, 40 and the channels 15, 25, 45. The gas and/or steam front 70 may heat the oil and reduce its viscosity to allow it to flow more easily. The gas and/or steam front 70 may also help drive the less viscous oil into the channels 15, of the wells 10, 20. As gas and/or steam is injected into the reservoir 5 through the third well 40, the wells 10, 20 may be continuously produced to help draw the gas and/or steam front 70 to the channels 15, 25 and the wells 10, 20. Oil and/or sand may be produced from the wells 10, 20 using the natural pressure in the reservoir, a pumping mechanism, and/or pressure developed in the reservoir 5 by injection of the gas and/or steam and formation of the gas and/or steam front 70. Gas and/or steam may be continuously injected into the reservoir 5 until one or more of the wells 10, 20 are in fluid communication with the third well 40.

In one embodiment, the wells 10, 20, 40 may be located relative to each other in any number of configurations within a reservoir 5. In one embodiment, the wells 10, 20, 40 may be drilled in any order. In one embodiment, the CHOPS process performed in the wells 10, 20, 40 may be performed in any order and for any duration of time. In one embodiment, the wells 10, 20, 40 may be produced from in any order and for any duration of time. In one embodiment, the third well 40 may be used to inject a hot gas and/or steam into the reservoir for any duration of time. In one embodiment, the third well 40 may be used to inject a hot gas and/or steam into the reservoir before, during, and/or after the CHOPS processes are at least partially performed in the wells 10, 20. In one embodiment, the wells 10, 20 may be produced from before, during, and/or after the injection of hot gas and/or steam into the reservoir 5 via the third well 40. The process steps described above with respect to FIGS. 1A-1D, 2A-2C, and 3 may be performed in any order and may be repeated in any order to enhance the recovery of hydrocarbons from a reservoir.

In one embodiment, the DHSG 90 may be any downhole steam generator operable to inject a hot fluid into a reservoir. The DHSG 90 may include any downhole steam/gas generation or mixing device known by one of ordinary skill. In one embodiment, one or more of the following fluids may be supplied to the DHSG 90 to generate and inject gas and/or steam into the reservoir 5 to heat and reduce the viscosity of the oil in the reservoir: steam, superheated steam, hydrogen, nitrogen, natural gas, methane, syngas, oxygen, air, oxygen enriched air, carbon dioxide, water, derivatives thereof, and combinations thereof. In one embodiment, one or more diluents, solvents, catalysts, nano-catalysts, and combinations thereof may be injected into the reservoir 5 via the wells 10, 20, 40 (including the DHSG 90) to enhance the recovery of the oil in the reservoir 5 before, during, and/or after one or more steps of the processes described above.

In one embodiment, a procedure for optimizing reservoir production using a CHOPS process and a gas and/or steam drive process may comprise performing a first combined CHOPS and gas and/or steam drive process at a first location, performing a second combined CHOPS and gas and/or steam drive process at a second location, and comparing the injection inputs and the production outputs to optimize subsequent combined CHOPS and gas and/or steam drive processes. The first combined CHOPS and gas and/or steam drive process may include forming one or more wells, at least partially performing CHOPS in at least one of the wells, and then performing a gas and/or steam drive process in at least one of the wells using a downhole steam generator. The time of injection/production and/or the amount of oil/sand recovered from the wells may be tracked and measured. The second combined CHOPS and gas and/or steam drive process may be similar as the first combined process, but may be performed at another location within the same reservoir, may be performed for a different amount of time, and/or until a different amount of oil/sand is recovered from the wells. The oil production and injection/production parameters from the first and second combined processes may be compared to each other to optimize subsequent combined processes in the reservoir to maximize oil recovery or output from the reservoir. The injection parameters may include the duration of injection and/or the amount/composition of fluids injected into the reservoir. The production parameters may include the duration of production and/or the amount/composition of reservoir products, including the amount of sand, recovered from the reservoir.

In one embodiment, at any point during the processes described above with respect to FIGS. 1A-1D and 2A-C, one or more of the formations surrounding the wells may be fractured using a variety of processes, such as fracture assisted steam technology ("FAST") and/or hydraulic fracturing techniques. The fractures in the formations may increase the permeability of the reservoir and increase the access to hydrocarbons therein. In one embodiment, one or more horizontal fractures may be formed in the formations, and the horizontal fractures may establish communication with adjacent wells. In one embodiment, a fluid such as steam may be injected into the wells until the reservoir pressure exceeds the fracture pressure of the formation. The fractures formed in the reservoir (and/or the channels) may be used to disperse fluid farther into the reservoir, such as a gas and/or steam front, and/or may be used to direct and recover hydrocarbons from the reservoir.

While the foregoing is directed to embodiments of the invention, other and further embodiments of the invention may be devised without departing from the basic scope thereof, and the scope thereof is determined by the claims that follow.

The invention claimed is:

1. A method for recovering oil from a reservoir, comprising:

drilling a first well into the reservoir;

producing a first portion of oil and sand from the reservoir through the first well;

drilling a second well into the reservoir;

locating a downhole steam generator in the second well;

injecting steam into the reservoir using the downhole steam generator to form a steam front; and producing a second portion of oil and sand from the reservoir through the first well, wherein the second portion of oil and sand is driven into the first well by the steam front.

2. The method of claim 1, further comprising producing oil and sand from the reservoir through the second well prior to locating the downhole steam generator in the second well.

3. The method of claim 1, further comprising drilling the second well after producing the first portion of oil and sand through the first well.

4. The method of claim 1, further comprising generating a plurality of channels that extend from the first well and flowing the second portion of oil and sand through at least one of the plurality of channels.

5. The method of claim 1, wherein the first well includes a first plurality of wells, and further comprising generating a first plurality of channels that extend from the first plurality of wells such that the channels establish fluid communication between the first plurality of wells.

6. The method of claim 5, wherein the second well includes a second plurality of wells, and further comprising generating a second plurality of channels that extend from the second plurality of wells such that the channels establish fluid communication between the second plurality of wells.

7. The method of claim 6, wherein the steam is injected into the reservoir via at least one of the second plurality of channels.

8. The method of claim 1, wherein producing the first portion of oil and sand through the first well includes pumping the first portion from the first well using a pumping device.

9. The method of claim 1, wherein the first portion of oil and sand produced through the first well is produced using reservoir pressure.

10. The method of claim 1, further comprising injecting a gas into the reservoir with the steam to form a gas and steam front, wherein the gas and steam front comprises at least one of water, superheated steam, carbon dioxide, oxygen, hydrogen, natural gas, methane, syngas, air, oxygen enriched air, and nitrogen.

11. A method for recovering oil from a reservoir, comprising:

performing a first CHOPS process in the reservoir and recovering oil through one or more first wells;

performing a second CHOPS process in the reservoir and recovering oil through one or more second wells;

injecting a fluid comprising steam into the reservoir using a downhole steam generator located in at least one of the one or more second wells to form a steam front; and recovering oil from the reservoir through the one or more first wells, wherein the oil is driven into the one or more first wells by the steam front.

12. The method of claim 11, further comprising creating a first plurality of channels that extend from the one or more first wells during the first CHOPS process.

13. The method of claim 12, further comprising creating a second plurality of channels that extend from the one or more second wells during the second CHOPS process.

14. The method of claim 13, wherein the first plurality of channels forms at least one fluid communication path between the one or more first wells.

15. The method of claim 14, further comprising locating the downhole steam generator in the one or more second wells after the second CHOPS process is at least partially complete and injecting the steam into the reservoir via the second plurality of channels.

16. The method of claim 15, further comprising driving the oil into the first plurality of channels using the steam front.

17. The method of claim 16, further comprising recovering the oil from the first plurality of channels through the one or more first wells.

18. The method of claim 17, further comprising recovering the oil from the first plurality of channels through the one or more first wells while injecting the steam into the second plurality of channels.

19. The method of claim 11, wherein at least oil and sand are recovered from the reservoir during the first CHOPS process and the second CHOPS process.

20. The method of claim 11, wherein the fluid further comprises a mixture including at least one of water, catalysts, nano-catalysts, diluents, solvents, superheated steam, carbon dioxide, oxygen, hydrogen, natural gas, methane, syngas, air, oxygen enriched air, and nitrogen.

21. The method of claim 11, further comprising injecting a diluent into the one or more first wells and the one or more second wells to cool products in the reservoir prior to recovering the oil to the surface.

22. The method of claim 11, further comprising:

pressurizing the reservoir by injecting the steam to form a pressure gradient in the reservoir.

23. The method of claim 22, wherein the pressure gradient forces the oil from the reservoir into the one or more first wells.

24. A method of recovering oil from a hydrocarbon-bearing reservoir having a first well and a second well, wherein the first well has been at least partially produced using a CHOPS process and includes one or more channels extending from the first well, comprising:

locating a downhole steam generator in the first well;

generating steam downhole using the downhole steam generator;

injecting gas and steam into the channels to form a gas and steam front in the reservoir;

heating hydrocarbons in the reservoir using the gas and steam front; and producing the heated hydrocarbons from the second well.

25. The method of claim 24, wherein the second well has been produced using a CHOPS process and includes one or more channels extending from the second well.

26. The method of claim 25, further comprising pressurizing the reservoir using the gas and steam front and moving the heated hydrocarbons into the one or more channels extending from the second well.

27. The method of claim 26, further comprising recovering the heated hydrocarbons from the one or more channels extending from the second well.

28. The method of claim 24, wherein the gas and steam front comprises at least one of water, superheated steam, carbon dioxide, oxygen, hydrogen, natural gas, methane, syngas, air, oxygen enriched air, and nitrogen.

29. The method of claim 24, wherein the gas and steam front comprises a gas front that moves ahead of a steam front throughout the reservoir.

30. A method for recovering oil from a reservoir, comprising:

drilling a first well into the reservoir;

producing a first portion of oil and sand from the reservoir through the first well;

locating a downhole steam generator in the first well;

injecting steam into the reservoir using the downhole steam generator; and producing a second portion of oil and sand from the reservoir through the first well, wherein the second portion of oil and sand is heated by the injected steam.

31. The method of claim 30, wherein the second portion of oil and sand is produced after removing the downhole steam generator from the first well.

32. The method of claim 30, wherein the second portion of oil and sand is flowed around the downhole steam generator in the first well.

* * * * *

UNITED STATES PATENT AND TRADEMARK OFFICE

CERTIFICATE OF CORRECTION

PATENT NO. : 8,899,327 B2
APPLICATION NO. : 13/117624
DATED : December 2, 2014
INVENTOR(S) : Kuhlman et al.

It is certified that error appears in the above-identified patent and that said Letters Patent is hereby corrected as shown below:

In the Specification:

Column 8, Line 15, please insert --25-- after 15,.

Signed and Sealed this
Ninth Day of June, 2015

Michelle K. Lee

Michelle K. Lee
*Director of the United States Patent and Trademark Office*